US009165548B2

(12) United States Patent
Møller

(10) Patent No.: US 9,165,548 B2
(45) Date of Patent: Oct. 20, 2015

(54) SYSTEM AND METHOD FOR ATTENUATING NOISE FROM A FLUID MACHINE OR A TURBULENT NOISE SOURCE

(75) Inventor: Henrik Møller, Aalborg (DK)

(73) Assignee: AALBORG UNIVERSITET, Aalborg (DK)

( * ) Notice: Subject to any disclaimer, the term of this patent is extended or adjusted under 35 U.S.C. 154(b) by 127 days.

(21) Appl. No.: 14/125,801

(22) PCT Filed: Jun. 14, 2012

(86) PCT No.: PCT/DK2012/050203

§ 371 (c)(1),
(2), (4) Date: Dec. 12, 2013

(87) PCT Pub. No.: WO2012/171533

PCT Pub. Date: Dec. 20, 2012

(65) Prior Publication Data

US 2014/0133667 A1 May 15, 2014

(30) Foreign Application Priority Data

Jun. 15, 2011 (DK) ..... 2011 70302

(51) Int. Cl.
*G10K 11/16* (2006.01)
*G10K 11/178* (2006.01)

(52) U.S. Cl.
CPC ..... *G10K 11/178* (2013.01); *G10K 11/1788* (2013.01); *G10K 2210/104* (2013.01); *G10K 2210/109* (2013.01); *G10K 2210/112* (2013.01)

(58) Field of Classification Search
CPC ..... G10K 2210/112; G10K 11/1788
USPC ..... 381/71.5
See application file for complete search history.

(56) References Cited

U.S. PATENT DOCUMENTS 4,947,434 A 8/1990 Ito
5,119,902 A 6/1992 Geddes (Continued)

FOREIGN PATENT DOCUMENTS

JP 2285799 11/1990
JP 6289880 10/1994

(Continued)

OTHER PUBLICATIONS

Juri Prezejl et al: 'A secondary source configuration for control of a ventilation fan noise in ducts' Strojniski Vestnik—Journal of Mechanical Engineering vol. 57, No. 06, Jun. 10, 2011.

(Continued)

*Primary Examiner* — Simon King
(74) *Attorney, Agent, or Firm* — Pearl Cohen Zedek Latzer Baratz LLP

(57) ABSTRACT

A noise cancellation system for transporting a fluid (M) from an inlet in one space (RM1) to an outlet in another space (RM2). A noisy element(VF, HA), e.g. a ventilation fan (VF) or a turbulent noise source (HA),generates acoustic noise. A loudspeaker (L) with a diaphragm (D) is arranged such that a first side (S1) of the diaphragm (D) is in contact with the fluid (M) on a first side (P1) of the noisy element(VF), and a second side (S2) of the diaphragm (D) is in contact with the fluid (M) on a second side (P2) of the noisy element (VF). The loudspeaker diaphragm (D) is arranged to move substantially in anti-phase with at least a part of the noise generated by the noisy element (VF), hereby cancelling the noise from the noisy element (VF). The noisy element may be placed inside a duct system. Especially, the system may be a decentral ventilation system with a noisy ventilation fan (VF) for transporting air between two spaces, e.g. two rooms, or between one room and "free air".

15 Claims, 3 Drawing Sheets

(56) References Cited

U.S. PATENT DOCUMENTS

| | | | | |
|---|---|---|---|---|
| 5,377,275 | A | 12/1994 | Suzuki | |
| 5,432,857 | A | 7/1995 | Geddes | |
| 7,383,607 | B2 | 6/2008 | Johnson | |
| 2010/0028134 | A1 * | 2/2010 | Slapak et al. | 415/119 |

FOREIGN PATENT DOCUMENTS

| | | |
|---|---|---|
| JP | 9212176 | 8/1997 |
| JP | 11022051 | 1/1999 |
| JP | 2006118422 | 5/2006 |
| WO | WO 95/31805 | 11/1995 |

OTHER PUBLICATIONS

International Search Report for International Application PCT/DK2012/050203 dated May 13, 2013.

First Examination Report for Danish Patent Application PA 2008 00944 dated Jan. 21, 2009.

* cited by examiner

SYSTEM AND METHOD FOR ATTENUATING NOISE FROM A FLUID MACHINE OR A TURBULENT NOISE SOURCE

CROSS-REFERENCE TO RELATED APPLICATIONS

This application is a National Phase Application of PCT International Application No. PCT/DK2012/050203, entitled "SYSTEM AND METHOD FOR ATTENUATING NOISE FROM A FLUID MACHINE OR A TURBULENT NOISE SOURCE", International Filing Date Jun. 14, 2012, published on Dec. 20, 2012 as International Publication No. WO 2012/171533, which in turn claims priority from Danish Patent Application No. PA 2011 70302, filed Jun. 15, 2011, all of which are incorporated herein by reference in their entirety.

FIELD OF THE INVENTION

The invention relates to the field of noise control. Especially, the invention relates to the field of silencing noise in a fluid transporting system, e.g. noise from a fluid machine, e.g. a ventilation fan, or a turbulent element in a ventilation system. More specifically, the invention provides a system and a method for reducing noise in a fluid transporting system.

BACKGROUND OF THE INVENTION

Active noise cancellation is well-known within many noise control applications, e.g. control of noise in ducts, such as attenuation of fan noise in a ventilation system. In principle, a loudspeaker is positioned in connection with the duct and supplied with an electric input signal such that the loudspeaker produces an acoustic output that essentially cancels the acoustic noise emitted in the duct. Loudspeakers capable of producing an acoustic output sufficient to cancel noise at medium frequencies can easily be found, and such loudspeakers can be fitted in the duct system, since they will typically have a reasonable size compared to the size of the duct system. Compared to passive silencers using the reflective chamber principle, the absorption principle, or the ¼, -wavelength resonator principle, active noise cancellation systems can in many applications provide advantageous solutions with respect to the required size. Especially, active noise cancellation is advantageous for cancellation of noise with significant pure tone components.

Low frequency noise, such as low frequency tonal components originating from the blade frequency of a propeller, a fan or the like, requires a high acoustic output for cancellation, e.g. in the frequency range 20-200, Hz or even lower. This is the case e.g. in air conditioning and/or ventilation duct systems with one or more large ventilation fans providing air flow in the duct system. Passive silencers to effectively attenuate such low frequency components have large dimensions, and thus active noise cancellation is an alternative. However, still high output at low frequencies requires a loudspeaker system with a large total diaphragm area, and in order to provide an acceptable electric to acoustic transfer efficiency, such loudspeaker system will require a cabinet with a large volume, such as a closed box or a bass reflex box. Such loudspeaker system is a standard component and can thus be achieved in low price versions, and the physical fitting between loudspeaker cabinet and duct to be silenced is rather simple. However, the size of such loudspeaker is a problem in many applications, since most often e.g. ventilation ducts are fitted into a rather small space and thus extra space for a large loudspeaker cabinet is difficult or even impossible to find. In principle, it is possible to obtain a large low frequency acoustic output from a loudspeaker in a small cabinet, however this requires a powerful and therefore expensive power amplifier together with a loudspeaker driver with a high power handling capacity.

U.S. Pat. No. 4,947,434, discloses an active noise cancellation system for cancelling noise in a ventilation duct with the use of a loudspeaker with a sheet-like shape and made of a piezoelectric material without any cabinet. The sheet-like loudspeaker can be bent into e.g. a tubular shape and thus fit along a wall of a tubular shaped duct, or it can be mounted on an outside wall of the duct. By the use of a large and flat loudspeaker, space is saved compared to the use of a conventional electro-dynamic loudspeaker driver. However, such flat loudspeaker driver is rather expensive since it is not a standard component, and in spite of a larger diaphragm area, it will not be able to produce large acoustic outputs at low frequencies.

JP 2006 118422, by Canon Inc. discloses an active noise reducing device for reducing noise from a ventilation fan placed inside an electronic apparatus. A loudspeaker is placed in a noise cancellation branch duct which is connected respectively to the inlet and outlet side of the ventilation fan, and by means of an active feedback system, the loudspeaker acoustically "short circuits" the noise source inside the electronic apparatus, thereby reducing fan noise transmitted to the environments by the electronic apparatus. However, such system is not intended to nor suited to attenuate noise at very low frequencies, i.e. below 200 Hz, which is the frequency range that causes the major noise problems in room ventilation systems.

SUMMARY OF THE INVENTION

Thus, according to the above explanation, it is an object of the present invention to provide a system and method for cancellation of noise from a noisy element, e.g. a ventilation fan or a pump, placed to transport fluid, e.g. air, between two separate rooms. The method should be able to provide an effective attenuation of high level acoustic noise at low frequencies, i.e. below 200, Hz, and further the method should be able to utilize standard components and only require a limited space.

In a first aspect, the invention provides

- a fluid machine, such as a ventilation fan or a pump, arranged to generate a flow of fluid between the inlet and outlet,
- a noise generating element, such as the fluid machine or a an element generating turbulence, arranged between the inlet and outlet, wherein the noise generating element generates acoustic noise upon operation, and
- a loudspeaker including a diaphragm, wherein the loudspeaker is arranged in relation to the system such that a first side of the diaphragm is in contact with the fluid on a first side of the noise generating element, and a second side of the diaphragm is in contact with the fluid on a second side of the noise generating element, wherein the loudspeaker diaphragm is arranged to move substantially in anti-phase with at least a part of the acoustic noise generated by the noise generating element so as to substantially cancel acoustic noise originating from the noise generating element.

The system transports fluid, e.g. air, between two spaces, here the two spaces are understood as two separate spaces between which the fluid is prevented from flowing except through the defined system. Examples of such two spaces are two rooms of a building, where walls prevent air from flowing between the two rooms, except through a ventilation system.

The first room may be outside the building, i.e. in "free air", whereas the second room may be a room inside the building.

The defined noise cancellation system is advantageous since the loudspeaker provides a cancellation of noise produced by the noise generating element, e.g. a ventilation fan or an element being a source of turbulent noise, without the need for a large cabinet, since the loudspeaker is arranged in relation to the noise generating element such that it essentially "short-circuits" the acoustic noise generated by the noise generating element and transmitted via the fluid. In case of a ventilation system, this noise cancellation method can be effective to cancel both noise from a ventilation fan and flow related noise such as turbulent noise generated by e.g.: sharp edges of the duct system, a filter unit, a heat exchanger or the like.

The loudspeaker preferably introduces an acoustical impedance which is much lower than in the system without the loudspeaker. This low acoustical impedance thus essentially short-circuits the acoustic volume flow, preventing it from propagating further downstream in the fluid transporting duct. In some embodiments, the loudspeaker may be positioned such that is attenuates the noise on both sides of the noise generating fluid machine.

In the prior art solution for attenuating fan noise inside an electronic apparatus disclosed in JP 2006 118422, the noisy fan as well as the noise cancellation loudspeaker both function as acoustic dipole sources. This means that such system is not effective at low frequencies, and this is normally not a problem in an electronic apparatus with a small ventilation fan. However, in the ventilation system according to the invention, two different spaces are connected by the ventilation system and thus both noise source and loudspeaker function as acoustic monopoles, and as a result the noise cancellation loudspeaker will be effective also at low frequencies which normally causes problems in large room ventilation systems.

Thus, the loudspeaker, whether in a passive or in an active version, is suited for suppression of low frequency noise from e.g. the fluid machine, and possibly other noisy components comprised within the system, e.g. inside a duct system, without the need for occupying a large space to a noise cancellation loudspeaker cabinet. Hereby, the system is applicable in the form of such as ventilation systems, air conditioning systems, or heating systems for dwellings and offices, where such systems must be fitted in small spaces. However, the system is applicable also for ventilation systems, air conditioning systems, or heating systems in theatres, cinemas, concert halls etc. where a low ventilation noise level is required.

In some embodiments, the noise generating element is the fluid machine, e.g. ventilation fan or pump, may extend completely from inlet to duct outlet of the system, e.g. if placed in a wall separating the first and second spaces which are adjacent, e.g. two adjacent rooms.

However, the system may also comprise a duct system interconnecting the inlet and outlet, wherein the fluid machine is arranged inside the duct system. By 'duct system' is understood broadly as meaning a system of at least one duct part, i.e. a cavity, either in the form of a piping or other sort of enclosure forming a cavity which is fully or at least substantially fluid tight.

The noise cancellation system can be provided by means of a standard active loudspeaker driver with a motor system, such as a normal electro-dynamic woofer with a cone shaped diaphragm, and thus the loudspeaker can be a low cost standard component, e.g. a typical loudspeaker unit with a diaphragm driven by an electro-magnetic motor system. In active embodiment, the loudspeaker is electrically controlled so as to force its diaphragm to move in anti-phase with the noise generated by the noise generating device.

In other versions, the loudspeaker is a passive loudspeaker, i.e. a diaphragm without a motor system arranged to actively drive the diaphragm, or an active loudspeaker with the motor system not connected or connected solely to passive components, e.g. a resonance circuit comprising a capacitor and a coil. In a passive embodiment, the diaphragm of the passive loudspeaker is mechanically arranged, such as with respect to moving mass and suspension compliance, so as to acoustically short-circuit at least a part of the acoustic noise generated by the noise generating element, e.g. the fluid machine. Thus, the diaphragm is preferably designed such that its moving mass and suspension is matched with the air to provide a resonance frequency in the frequency range where the highest noise cancellation effect is desired.

Compared to the passive implementation, the active implementation has a potential to provide effective noise cancellation in a wider frequency range. However, e.g. several parallel coupled passive loudspeakers with different resonance frequencies may be combined to provide a wider frequency range of cancellation. In principle, the passive or active implementations can be positioned in the same manner, as will be illustrated in the following embodiments. The loudspeaker may be arranged within the duct system in different ways. E.g. the loudspeaker may be arranged with the diaphragm adjacent to the inlet or the outlet, e.g. such that the diaphragm is substantially parallel with a plane formed by an opening of the inlet or outlet.

In specific embodiments, the loudspeaker and preferably also an associated noise cancellation control system, can be placed within a decentral ventilation inlet or outlet module also including a ventilator fan arranged within a duct system. The loudspeaker may be arranged such that the diaphragm is positioned within a boundary of a duct inlet opening or a duct outlet opening, such as the loudspeaker being arranged such that the diaphragm is positioned in a centre of the duct inlet opening or duct outlet opening.

As a further alternative, the loudspeaker may be arranged such in relation to system that the first side of the diaphragm is in contact with the fluid, e.g air, adjacent to the inlet, and the second side of the diaphragm is in contact with the fluid adjacent to the outlet. Such embodiment is useful for noise cancellation of a ventilation fan placed in a hole in a wall, e.g. a brick or concrete wall, where the loudspeaker thus serves to acoustically short-circuit the noise from one side of the fan on one side of the wall and from the other side of the fan on the opposite side of the wall.

Active embodiments preferably include a controller system, e.g. comprising a processor system, arranged to apply an electric signal to the loudspeaker motor to force the loudspeaker diaphragm to move substantially in anti-phase with the at least part of the acoustic noise generated by the noise generating device. The controller system or processor system and its operating algorithm is considered outside the scope of the present invention. In principle, the controller system required to generate the electric input to the loudspeaker can operate according to any suitable algorithm such as known in the art of noise cancellation. Typically, such system is arranged to acquire a signal representing the noise generated by the noise generating element, e.g. the fluid machine, such as acquiring an acoustic signal with a microphone, or a vibration signal with an accelerometer, and generate the electric signal as a function of the signal representing the noise generated by the noise generating device. In some embodiments, the loudspeaker is controlled by a feedforward controller system taking input from a microphone placed near the noise source to be cancelled. Still further, the controller system may be a hybrid system, i.e. a mix between a feedforward and a feedback approach. In relation to a feedforward solution, an error signal microphone can be omitted, and instead a feedforward microphone is used and with knowledge of the relevant transfer functions, an error signal can be calculated. Such principle is known as "virtual microphone".

Alternatively, the controller system is arranged to generate the electric input to the loudspeaker based on an input which is not directly related to the acoustic noise. Such input may be a tachometer signal, e.g. based on a tachometer detecting a rotation speed or an actual blade frequency of a noise generating ventilation fan. As another option for such input is an electric signal derived from the electric supply voltage to the noise generating device. Such input signals provide the possibility of synchronizing, e.g. to one or several specific frequency components of the acoustic noise, but without the need for directly measuring the acoustic noise. The controller system may be implemented with a digital processor system and/or analog electric circuits.

As a further option, the controller system may be arranged to perform an electric measurement on the loudspeaker motor so as to derive a measure of acoustic load of the diaphragm. Such measure can be used as input to an algorithm generating the electric signal to drive the loudspeaker motor and thus the diaphragm. Hereby the loudspeaker itself serves as a feedback microphone and thus a dedicated microphone can be eliminated. Such electric measurement is preferably in the form of a measurement of the electric impedance of the loudspeaker motor, and such measurement can be performed constantly or can be performed only once or at regular intervals. Thus, especially the controller system may be arranged to generate the electric signal to the loudspeaker motor based on said measure of acoustic load of the loudspeaker diaphragm. In particular, the controller system may be arranged such that said measure of acoustic load of the loudspeaker diaphragm is the only input to the controller system of the acoustic noise to be cancelled, thus eliminating the need for a microphone, thus making the noise cancellation part of the system simpler.

Especially, the controller system may include a filter arranged to limit a frequency range of the electric signal applied to the loudspeaker, such as to limit the frequency range to substantially below 500 Hz, such as substantially below 200 Hz, such as below substantially below 100 Hz, such as substantially below 50 Hz. Hereby the noise cancellation system will be suited to attenuate low frequency noise components without the possibility of introducing additional noise towards higher frequencies, where it is known that active noise cancellation is less suited.

In one embodiment, comprising a duct system, the loudspeaker is arranged in a noise cancellation duct part with one end connected on one side of the noise generating element, and wherein the second end of the noise cancellation duct part is in connection with the fluid outside the duct system. In other words, in such embodiment the loudspeaker is arranged in a noise cancellation duct part forming a noise cancellation duct branch of the duct system parallel with the duct branch where the noise generating element is positioned. This noise cancellation duct branch acoustically "short-circuits" the noise generating element.

In many embodiments it may even be possible that the acoustic output from the end of the noise cancellation branch will cancel noise radiated from the end of the duct system. Further, the noise cancellation branch can be very short, thereby saving total space occupied by the noise cancellation system. Especially, the duct end and the end of the noise cancellation branch can be integrated, i.e. built close together and e.g. hidden behind one common protection grid. However, in principle it is understood that "in contact with the air" in this connection is understood that both the duct end and one side of the loudspeaker diaphragm are both in contact with "free air", i.e. the air outside the duct system.

Depending on the size of the loudspeaker, the noise cancellation branch of the duct system used to acoustically connect the two sides of the diaphragm with opposite sides of the noise generating element can have a significantly lower cross sectional area than the main duct system. Hereby, this extra branch will only occupy a small space compared to the duct system without active noise cancellation. Preferably, the noise cancellation duct part where the loudspeaker is arranged, does not have any flow of the fluid.

The loudspeaker may be arranged with its diaphragm extending in a plane substantially parallel with a direction of flow of the fluid in a part of the duct system where the first side of the diaphragm is in contact with the fluid. Especially, the loudspeaker may be arranged in a wall of the duct such that its diaphragm is substantially flush with the wall of the duct. Alternatively, the loudspeaker may be arranged with its diaphragm extending in a plane substantially parallel with a cross section of the noise cancellation duct part of the duct system without any flow of the fluid. Especially, the loudspeaker may be arranged such that it essentially blocks the entire cross sectional area of the noise cancellation duct part with its diaphragm, e.g. with the diaphragm substantially parallel with a plane formed by an opening of the duct inlet or duct outlet, as already mentioned.

As already addressed, the loudspeaker in an active implementation may be a standard component, such as a conventional loudspeaker driver, e.g. a standard electro-dynamic woofer with a cone-shaped diaphragm. Of course, the loudspeaker needs to be suited to be in contact with the fluid and possibly also fitted to withstand a static fluid pressure, depending on the position in the fluid transporting system.

In a passive implementation the loudspeaker is a passive loudspeaker with its diaphragm having a mass, wherein the diaphragm is suspended by a suspension providing a compliance. Especially, the mass and compliance are preferably selected such that the diaphragm is arranged to move substantially in anti-phase with at least one tonal component of the acoustic noise generated by the ventilation fan. The passive loudspeaker may be an active loudspeaker unit with its motor disconnected or connected solely to passive components, e.g. a passive filter such as in the form of a resonance circuit.

In a special embodiment, the passive loudspeaker is implemented as a panel arranged to form part of a wall of the duct system, wherein the panel is shaped such that it forms a stationary part and a suspension, and wherein the diaphragm is connected to the stationary part via the suspension.

As a passive loudspeaker a normal loudspeaker driver with a motor system that is not connected or driven by an electrical signal may be used, however, in principle any type of diaphragm will qualify as a passive loudspeaker, provided that it has a suitable moving mass and suitable suspension to provide a resonance frequency in the desired frequency range where cancellation is intended. Thus, very simple materials may be used to provide the loudspeaker diaphragm in the form of a panel, e.g. thin metal plate, provided with grooves to form a suspension for a moving area, which can be suitable as a diaphragm vibrationally separated from a non-moving part of the metal plate. More specifically, the panel may be formed from a plate with the suspension and diaphragm formed as concentric circular elements.

In preferred embodiments, the system is a ventilation system, wherein the fluid machine comprises or is a ventilation fan, and wherein the fluid is air. The ventilation fan may itself form part of the noise generating element, and/or the noise generating element may comprise one or more turbulent noise sources, e.g. heat exchanger, sharp edges, bends of the duct etc.

Especially, the ventilation system may be a decentral ventilation system. E.g. such decentral ventilation system may be an air conditioning unit or a heating unit, especially small units arranged to operate independently since it is not connected to a common air supply duct. By a 'decentral ventilation system' is understood a ventilation system where a ventilation unit is located directly in the same room as it supplies with fresh air, basically without any ducts (or only very short ones) as opposed to a central ventilation unit which is located in another room or on the roof, and supplies the room with fresh air through (relatively long) ducts.

The system may include two or more separate noise generating elements, e.g. two or more ventilation fans and/or other noisy equipment in the duct system, e.g. a heat exchanger creating turbulent noise. The loudspeaker may in such embodiment be arranged in relation to first and second noise generating components, such that the first side of the diaphragm is in contact with the air on one side of the first noise generating component and the second side of the diaphragm is in contact with the air on one side of the second noise generating component. Alternatively, if the noise source are placed at different positions in a duct system, a first loudspeaker may be arranged in the duct system so as to cancel noise from the first noise generating component, e.g. an inlet fan, while a second loudspeaker is arranged in the duct system so as to cancel noise from the second noise generating component, e.g. an outlet fan. The first and second loudspeakers may have one common processing system or separate processing systems, in case of active implementations. Alternatively, a passive loudspeaker may be used for the first noise source, while an active loudspeaker system is used for the second noise source.

Apart from the fluid machine, e.g. ventilation fan, the loudspeaker system according to the invention can attenuate noise from other noise sources within a duct system. E.g. it is appreciated, that components related to the duct system itself can be considered as noise source, e.g. walls of the duct may oscillate due to fluctuation of flow in the air and thus generate acoustic noise in and outside the duct.

In preferred embodiments, the first space and the second space are physically separated by a barrier, such that the first and second sides of the diaphragm act as respective acoustic monopoles in the first and second spaces. Hereby, the noise cancellation can be effective at low frequencies.

In preferred embodiments, the loudspeaker is positioned such that a distance from one side of the diaphragm to a point of summation for cancellation in the medium, such as inside a duct, is smaller than a distance from the noise generating element to the point of summation for cancellation.

As already mentioned, even small ventilation systems can benefit from the invention, especially with respect to obtaining attenuation of low frequency noise with an active noise cancellation system with reasonable costs and with a limited requirement for extra space.

In a second aspect, the invention provides a method for attenuating noise from a noise generating element forming part of a system with a fluid machine for transporting fluid from a first space to a second space, the method including arranging a loudspeaker in connection with the system, wherein the loudspeaker includes a diaphragm, and wherein the loudspeaker is arranged such that a first side of a the diaphragm is in contact with the fluid on a first side of the noise generating element, and a second side of the diaphragm is in contact with the fluid on a second side of the noise generating element, and arranging the loudspeaker such that its diaphragm moves substantially in anti-phase with at least a part of the noise generated by the fluid machine so as to reduce noise generated by the noise generating element.

E.g. the method may be utilized by forming a noise reduction kit with components and instructions allowing a user to perform the method.

It is appreciated that the same advantages as explained for the first aspect apply as well for the second aspect. Further, it is appreciated that embodiments equivalent to those defined for the first aspect apply as well for the second aspect.

BRIEF DESCRIPTION OF DRAWINGS

In the following, the invention will be described in more details by referring to embodiments illustrated in the accompanying drawings, of which

DETAILED DESCRIPTION OF THE INVENTION

Figure 1A:
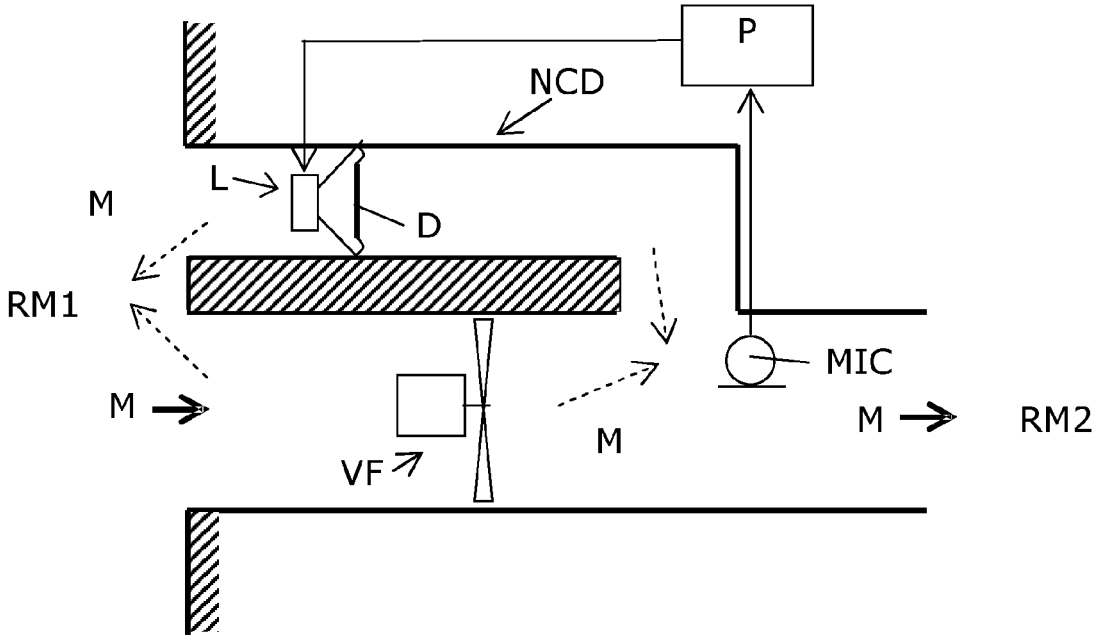
FIG. 1*a* illustrates a sketch of a simple ventilation duct system with a ventilation fan as a noise source and a noise cancellation loudspeaker positioned in relation thereto.

In the following, examples of the invention are described with ventilation systems as examples only, i.e. where the fluid machine is in the form of a ventilation fan generating a flow of air between inlet and outlet, e.g. between inlet and outlet of a duct system arranged for transporting the air between two spaces. The noise generating element is thus partly the ventilation fan, and partly other noise generating elements in the ventilation system, such as elements generating flow related noise due to turbulence, e.g. filters, heat exchangers, sharp edges, bends of the duct etc.

FIG. 1 *a*illustrates a side section view of a ventilation system including a duct system with one end to the left, e.g. inlet, and another end to the right, e.g. outlet. The duct system transports air M from inlet to outlet by means of flow generated by a ventilation fan VF and thus transports air between two separate rooms RM1 and RM2. The ventilation fan VF generates acoustic noise, i.e. noise generated by the fan blades and by the motor driving the fan. The ventilation fan is positioned inside a part of the duct system. An active noise cancellation system in the form of a loudspeaker L with a diaphragm D and a processor system P are provided to attenuate acoustic noise radiated from the ventilator fan VF by radiating acoustic waves in anti-phase, or at least substantially anti-phase, with the noise generated by the ventilation fan VF.

The loudspeaker L is arranged such in relation to the duct system, that a first side of its diaphragm D is in acoustic contact with the medium M at one side of the ventilation fan VF, while the opposite side of the diaphragm is in contact, via a noise cancellation duct part NCD, with the opposite side of the ventilation fan VF. By the formulation "side of the ventilation fan VF (i.e. side of the noise generating element) is understood a side seen in relation to a direction of flow of air M in the duct part where the ventilation fan VF is positioned. I.e. if one side is positioned up-stream in relation to the ventilation fan VF, then the opposite side P2 is positioned down-stream in relation to the ventilation fan, or vice versa.

With the illustrated position of the loudspeaker L in FIG. 1, the ventilation fan VF is acoustically "short-circuited" by acoustic waves generated by the loudspeaker L, since the noise cancellation duct branch NCD including the loudspeaker L is in parallel with the main duct part where the ventilation fan VF is positioned. The dashed arrows indicate the acoustic short-circuiting on both sides of the fan VF. As seen, to one side, this short-circuiting takes place outside the duct system, since both the inlet opening and opening of the noise cancellation duct part NCD are in the same plane. On the opposite side of the fan VF, two dashed arrows also indicate short-circuiting of waves from the opposite side of the diaphragm D inside the duct system.

As illustrated, the loudspeaker L blocks the entire opening of the noise cancellation duct part NCD, and thus there is no transport of the air M through this duct part NCD. For illustration purposes, the dimensions of the noise cancellation duct part NCD is of the same order as the dimensions of the major duct part. However, in practice the noise cancellation duct part NCD may be formed significantly smaller than the major duct part, and thus the extra space required for the active noise cancellation addition to the duct can be very limited, since the large cabinet of prior art systems is eliminated. The required extra duct NCD can be formed in the same material as the major duct part, e.g. as pipes with rectangular or circular cross section shapes. It can even easily be fitted as an add-on to existing duct systems.

In the embodiment of FIG. 1*a*, a processor system P running a noise cancellation algorithm takes an input from a microphone MIC positioned at the duct outlet. Such microphone may be positioned differently, and as already addressed, different inputs not using a microphone can be used for to provide a feedback to the noise cancellation algorithm that is used to generate the electric signal which is applied, after appropriate amplification, to the motor system of the loudspeaker L.

Figure 1B:
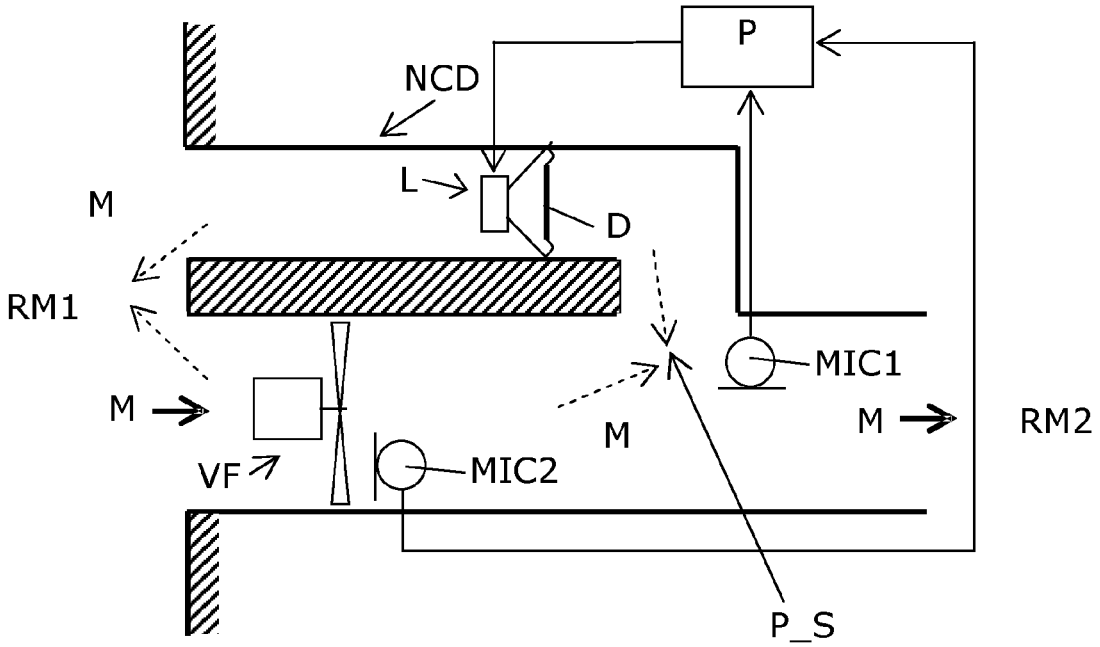
FIG. 1*b* illustrates a sketch of a slightly different version of the system of FIG. 1*a*, FIGS. 2*a* and 2*b* illustrate two other examples of a ventilation duct system with a noise cancellation loudspeaker at different positions in a ventilation duct system with the noise source being the ventilation fan and a heat exchanger positioned in the duct system.

FIG. 1*b* shows a slightly different version of the system of FIG. 1*a*. In the version of FIG. 1*b*, the loudspeaker L is positioned in the duct such that a distance from one side of the diaphragm D to a point of summation for cancellation P_S in the medium M inside a duct, is smaller than a distance from the noise generating element, i.e. the ventilation fan VF, to the point of summation for cancellation P_S. This relative position of the loudspeaker L and ventilation fan VF inside the duct, where the loudspeaker L is closer to the summation point inside the duct is better suited for causal feedforward solution, and a system which is better suited to attenuate stochastic noise. Further, compared to FIG. 1*a*, a second microphone MIC2 has been added, a microphone which is positioned close to the ventilation fan VF and thus captures the noise close to the noise source.

Figure 2A:
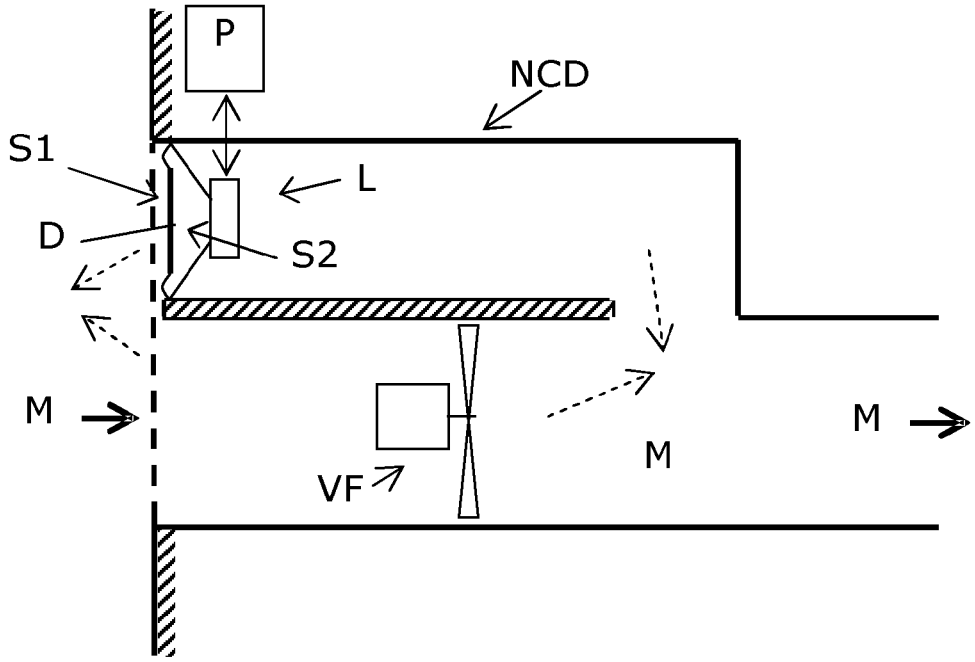

FIG. 2*a* shows an alternative configuration of the loudspeaker L. Here, the loudspeaker L is placed in a noise cancellation duct part NCD as in FIG. 1, but the loudspeaker L is placed immediately adjacent to the ventilation duct inlet with its diaphragm D substantially parallel with an opening of the ventilation duct inlet. Again, such that the first side S1 of the diaphragm D is in contact with the air M outside the duct system on one side of the ventilator fan VF, as illustrated by the dashed arrows, while the on the opposite side of the ventilator fan VF, the second side S2 of the diaphragm D is in contact with the air M inside the duct system.

The processor system P generating the electric signal to the motor system of the loudspeaker for controlling movements of the diaphragm D so as to cancel noise, is here illustrated as also receiving a signal from the loudspeaker L. In the shown embodiment the processor system P does not take any further input to the noise cancellation algorithm than a measured electric impedance of the loudspeaker L which can be used as a feedback of the acoustic load of the diaphragm D and thus as a measure of the acoustic noise present at the diaphragm D. This provides a simple processor system P without the need for additional transducers which thereby eliminates a source of error in the noise cancellation system.

In the configuration shown in FIG. 2, a front grid, shown with a dashed line, covers both of the noise cancellation duct part NCD opening and the ventilation duct inlet opening, and thus from the outside, the presence of the noise cancellation duct part NCD and the loudspeaker L can be formed such that it is not visible. The shown duct system part is suited to form a ventilation inlet/outlet module in a decentral ventilation system.

In alternative configurations, rather small loudspeakers may be placed in respective small noise cancellation duct parts with openings, e.g. two, three, four or more, arranged around one bigger circular or rectangular ventilation duct inlet or outlet opening. Alternatively, the noise cancellation duct part with the loudspeaker may be formed concentrically inside a surrounding ventilation duct inlet/outlet opening.

Figure 2B:
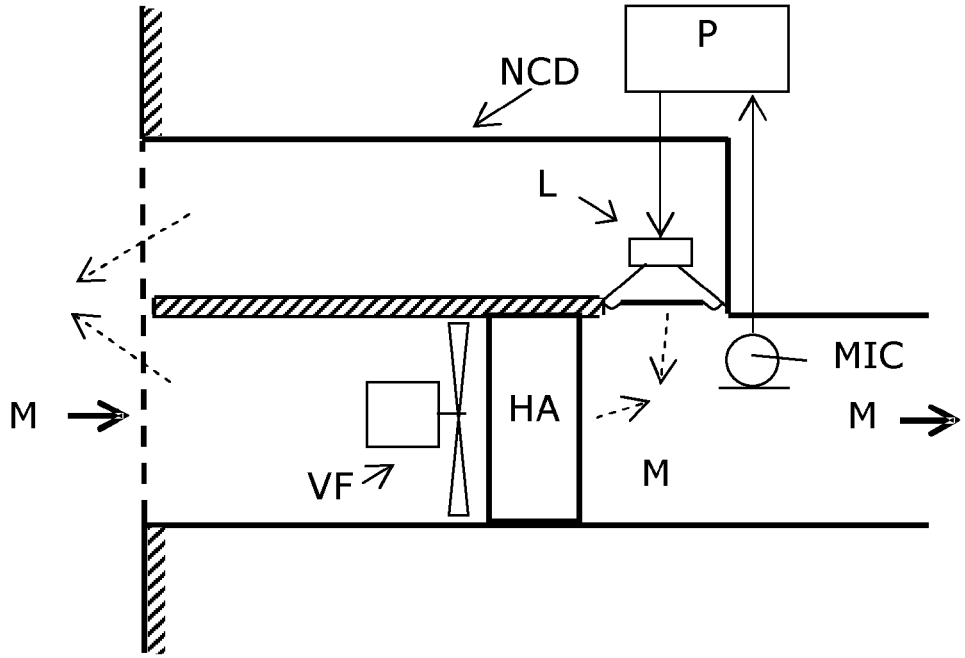

FIG. 2*b* illustrates another embodiment with similar elements as the embodiment of FIG. 2*a*, with the difference being the position of the loudspeaker L, which is here positioned in the end of the noise cancellation duct part NCD and flush with the main duct where the air M flows. Further, the noise generating element includes in this ventilation system, apart from the ventilation fan VF, a heat exchanger unit HA which generates flow related noise, e.g. due to turbulence ingestion. Since this heat exchanger unit HA is position adjacent to the ventilation fan VF, the loudspeaker L cancels noise from both of these noise sources. Furthermore, in the embodiment of FIG. 2*b*, a separate microphone MIC placed to sense noise in the main duct is illustrated to provide feedback to the processor P instead of the feedback method used in FIG. 2*a*.

Figure 3:
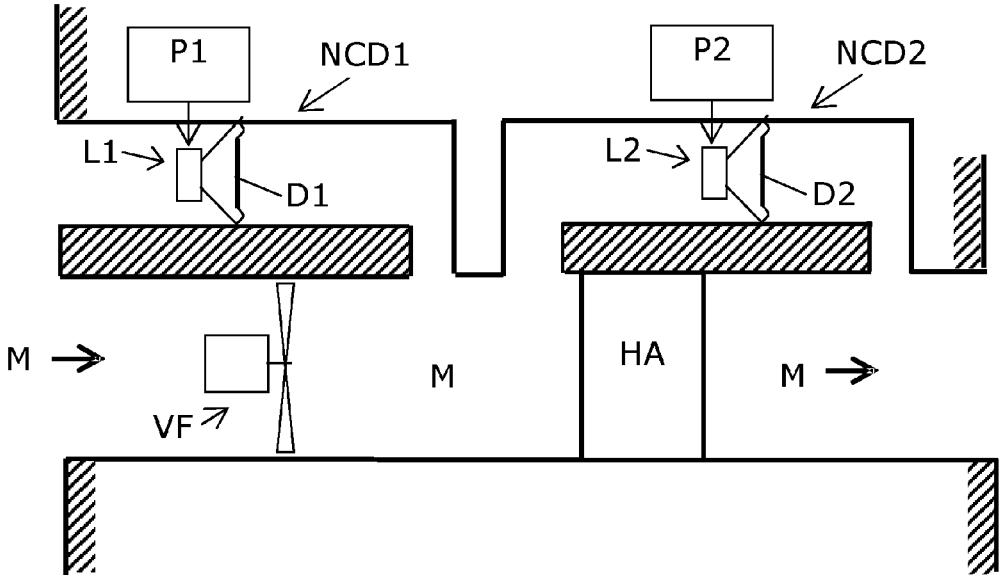
FIG. 3 illustrates an example of a ventilation system with two noise generating devices: a ventilation fan, and a heat exchanger, each supplied with its own separate noise cancellation system.

FIG. 3 illustrates another ventilation duct system embodiment with two noise generating devices: a ventilation fan VF and a heat exchanger HA which may generate turbulent noise and/or tonal noise (e.g. in case of a plate type heat exchanger with ringing plate elements). It is possible to use only one loudspeaker for cancelling noise from both noise sources VF, HA, if they are treated as one large noise source and both acoustically "short-circuited" by the loudspeaker such as described in connection with FIG. 1 or FIG. 2, even though they are spatially separated in the duct system. However, the embodiment illustrated in FIG. 3 includes two separate noise cancellation systems each including a loudspeaker (L1, L2)

and a processor system (P1, P2) connected thereto. Thus, the separate systems can be specifically designed to most effectively cancel noise from the specific type of noise source. As seen, the first loudspeaker L1 arranged to cancel noise from the ventilation fan VF is arranged inside a first noise cancellation duct part NCD1, while a second loudspeaker L2 arranged to cancel noise from the heat exchanger HA is positioned in a second noise cancellation duct part NCD2. The arrangement of the first loudspeaker L1 essentially corresponds to the configuration illustrated and explained in connection with FIG. 1.

As an alternative to the embodiment of FIG. 3, the system may have a second ventilation fan placed adjacent to the heat exchanger HA, such that the system has a fan VF placed near the inlet, and a second fan placed near the outlet.

With regard to FIGS. 2*a* and 3, these are merely sketches showing the basic components of principle system configurations. The same reasoning applies to the relative position of loudspeaker(s) and noise source as mentioned in relation to FIG. 1*b*.

Figure 4:
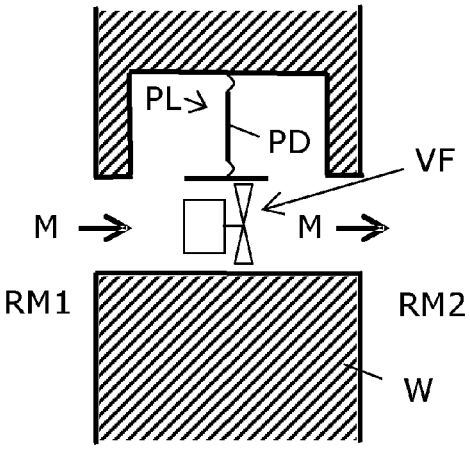
FIG. 4 illustrates an embodiment with the noise generating device, e.g. a ventilation fan, mounted in a wall, and with a passive loudspeaker.
Figure 5:
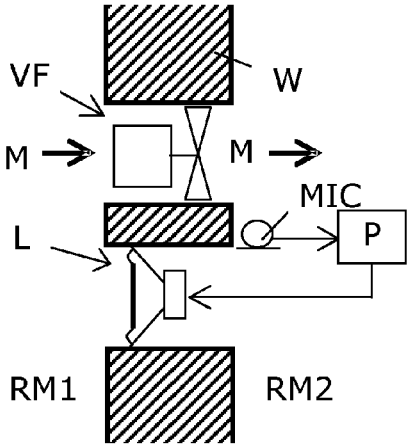
FIG. 5 illustrates another embodiment, here with an active loudspeaker, where a ventilation fan is mounted in a wall, wherein the ventilation fan completely fills the duct formed in the wall.

FIGS. 4 and 5 illustrate two different embodiments with a passive loudspeaker PL with a diaphragm PD mounted to cancel noise from a ventilation fan VF, which is positioned in a duct or enclosure formed by a wall W which separates two rooms RM1 and RM2, e.g. "indoor" and "outdoor". The bold arrows indicate direction of flow of air M. In the embodiments shown in FIG. 4, the diaphragm PD of the passive loudspeaker PL is designed such that it has a moving mass and a suspension matched with the medium, e.g. air, so as to provide a resonance frequency in the frequency range, e.g. tonal component, where the major noise cancellation effect is desired. Hereby, the diaphragm PD will move in anti-phase with the noise in the desired frequency range and thus cancel or at least reduce noise in this frequency range.

In FIG. 4 the wall W has a substantial extension compared to the ventilation fan VF, and thus the wall, or a pipe inserted therein, forms a duct in which the ventilation fan VF is positioned. A noise cancelling duct part is formed inside the wall W in connection with the duct part with the ventilation fan VF, and the passive loudspeaker PL is positioned with its diaphragm PD across this noise cancelling duct part.

In FIG. 5, the wall W is so thin compared to the ventilation fan VF, so that the duct formed in the wall W is completely filled by the ventilation fan VF. In this embodiment, the active loudspeaker L is simply mounted across an opening in the wall W in the vicinity of the ventilation fan VF. Hereby a very simple noise cancelling measure is provided. In this embodiment, a microphone MIC provides feedback to a processor P which controls the motor system of the loudspeaker L accordingly, so as to minimize noise from the ventilation fan VF, e.g. band limited to one or a few single tone components.

Passive or active embodiments can easily be formed as add-on systems to provide noise attenuation kits e.g. for attenuating tonal components from ventilation fans. E.g. active embodiments may be formed with a user control to allow the user to tune the kit to most effectively cancel the tonal component in questions. Passive noise attenuation kits may be formed with diaphragms which allow attachments of extra mass components so as to allow a user to match the resonance frequency of the diaphragm to most effectively attenuate an annoying tonal component.

To sum up, the invention provides a noise cancellation system for transporting a fluid (M) from an inlet in one space (RM1) to an outlet in another space (RM2). A noisy element (VF, HA), e.g. a ventilation fan (VF) or a turbulent noise source (HA), generates acoustic noise. A loudspeaker (L) with a diaphragm (D) is arranged such that a first side (S1) of the diaphragm (D) is in contact with the fluid (M) on a first side (P1) of the noisy element (VF), and a second side (S2) of the diaphragm (D) is in contact with the fluid (M) on a second side (P2) of the noisy element (VF). The loudspeaker diaphragm (D) is arranged to move substantially in anti-phase with at least a part of the noise generated by the noisy element (VF), hereby cancelling the noise from the noisy element (VF). The noisy element may be placed inside a duct system. Especially, the system may be a decentral ventilation system with a noisy ventilation fan (VF) for transporting air between two spaces, e.g. two rooms, or between one room and "free air".

Although the present invention has been described in connection with the specified embodiments, it is not intended to be limited to the specific form set forth herein. Rather, the scope of the present invention is limited only by the accompanying claims. In the claims, the term "comprising" or "including" does not exclude the presence of other elements. Additionally, although individual features may be included in different claims, these may possibly be advantageously combined, and the inclusion in different claims does not imply that a combination of features is not feasible and/or advantageous. In addition, singular references do not exclude a plurality. Thus, references to "a", "an", "first", "second" etc. do not preclude a plurality. Furthermore, reference signs in the claims shall not be construed as limiting the scope.

The invention claimed is:

1. A ventilation system arranged for transporting air from an inlet in a first space to an outlet in a second space, wherein a duct system interconnects the inlet and outlet, the ventilation system comprising:

a ventilation fan arranged to generate a flow of air, and being arranged inside the duct system between the inlet and outlet, wherein the ventilation fan generates acoustic noise upon operation, and a loudspeaker including a diaphragm, wherein the loudspeaker is arranged in relation to the duct system such that a first side of the diaphragm is in contact with the air on a first side of the ventilation fan, and a second side of the diaphragm is in contact with the air on a second side of the ventilation fan, wherein the loudspeaker diaphragm is arranged to move substantially in anti-phase with at least a part of the acoustic noise generated by the ventilation fan so as to substantially cancel acoustic noise originating from the ventilation fan, wherein the first space and the second space are physically separated by a barrier, such that the first and second sides of the diaphragm act as respective acoustic monopoles in the first and second spaces.

2. The ventilation system according to claim 1, wherein the loudspeaker is arranged in relation to the duct system such that the first side of the diaphragm is in contact with the air outside the duct system.

3. The ventilation system according to claim 2, wherein the loudspeaker is arranged with its diaphragm adjacent to the inlet or adjacent to the outlet.

4. The ventilation system according to claim 1, wherein the loudspeaker is arranged such that the diaphragm is positioned less than 100 cm from the inlet or outlet.

5. The ventilation system according to claim 1, wherein the loudspeaker is positioned such that the diaphragm is substantially parallel with a plane formed by an opening of the inlet or outlet.

6. The ventilation system according to claim 1, wherein the loudspeaker is arranged such that the diaphragm is positioned within a boundary of the inlet opening or outlet opening, such as the loudspeaker being arranged such that the diaphragm is positioned in a center of the inlet opening or outlet opening.

7. The ventilation system according to claim 1, wherein the loudspeaker is arranged such in relation to the duct system that the first side of the diaphragm is in contact with the air adjacent to the inlet, and the second side of the diaphragm is in contact with the air adjacent to the outlet.

8. The ventilation system according to claim 1, wherein the loudspeaker is arranged in a noise cancellation duct part with one end connected on one side of the ventilation fan, and wherein the second end of the noise cancellation duct part is in connection with the air outside the duct system.

9. The ventilation system according to claim 1, wherein the loudspeaker is arranged with its diaphragm extending in a plane substantially parallel with a direction of flow of the air in a part of the duct system where the first side of the diaphragm is in contact with the air.

10. The ventilation system according to claim 1, wherein the loudspeaker is arranged with its diaphragm extending in a plane substantially parallel with a cross section of a noise cancellation duct part of the duct system without any flow of air.

11. The ventilation system according to claim 1, wherein the loudspeaker comprises a motor arranged to drive the diaphragm, and wherein the ventilation system comprises a control system arranged to apply an electric signal to the loudspeaker motor to force the diaphragm to move substantially in anti-phase with the at least part of the acoustic noise generated by the ventilation fan, and wherein the control system includes a filter arranged to limit a frequency range of the electric signal applied to the loudspeaker motor to below 500 Hz.

12. The ventilation system according to claim 11, wherein the control system is arranged to perform an electric measurement on the loudspeaker motor so as to derive a measure of acoustic load of the diaphragm, and wherein the control system is arranged to generate the electric signal to the loudspeaker motor based on said measure of acoustic load of the loudspeaker diaphragm.

13. The ventilation system according to claim 1, wherein the ventilation system is a decentral ventilation system.

14. The ventilation system according to claim 1, wherein the loudspeaker is positioned such that a distance from one side of the diaphragm to a point of summation for cancellation in the air, is smaller than a distance from the ventilation fan to the point of summation for cancellation.

15. A method for attenuating noise from a ventilation fan forming part of a ventilation system with a ventilation fan arranged inside a duct system for transporting air from an inlet in a first space to an outlet in a second space, the method comprising:

arranging a loudspeaker in connection with the duct system, wherein the loudspeaker includes a diaphragm, and wherein the loudspeaker is arranged such that a first side of the diaphragm is in contact with the air on a first side of the ventilation fan, and a second side of the diaphragm is in contact with the air on a second side of the ventilation fan, and arranging the loudspeaker such that its diaphragm moves substantially in anti-phase with at least a part of the noise generated by the ventilation fan so as to reduce noise generated by the ventilation fan, wherein the first space and the second space are physically separated by a barrier, such that the first and second sides of the diaphragm act as respective acoustic monopoles in the first and second spaces.

* * * * *